US005615420A

United States Patent [19]

Guyton

[11] Patent Number: 5,615,420

[45] Date of Patent: Apr. 1, 1997

[54] FLUSHABLE PORTABLE TOILET

[75] Inventor: Dean L. Guyton, Glassboro, N.J.

[73] Assignee: Dgic, llc, Glassboro, N.J.

[21] Appl. No.: 534,390

[22] Filed: Sep. 27, 1995

Related U.S. Application Data

[63] Continuation-in-part of Ser. No. 38,924, filed as PCT/US94/03350 Mar. 29, 1994, abandoned.

[51] Int. Cl.[6] ..... A61G 9/02

[52] U.S. Cl. ..... 4/233; 4/457; 4/300.2; 4/340

[58] Field of Search ..... 4/457, 300.2, 233, 4/340, 341, 342, 307, 312, 429, 440, 442

[56] References Cited

U.S. PATENT DOCUMENTS

| | | | |
|---|---|---|---|
| 1,597,129 | 8/1926 | Watters . | |
| 1,630,932 | 5/1927 | Friedrich . | |
| 1,711,295 | 4/1929 | Wernle . | |
| 2,527,270 | 10/1950 | Levin . | |
| 2,611,134 | 9/1952 | Jarrett et al. . | |
| 2,834,026 | 5/1958 | Kronish . | |
| 2,986,745 | 6/1961 | Melzassard . | |
| 3,083,375 | 4/1963 | Jewell . | |
| 3,166,767 | 1/1965 | Jewell et al. . | |
| 3,327,323 | 6/1967 | Miller, Jr. . | |
| 3,742,522 | 7/1973 | Stevenson . | |
| 4,366,584 | 1/1983 | Mchuma . | |
| 4,552,515 | 11/1985 | Endo | 417/472 |
| 4,759,085 | 7/1988 | Ottosson . | |
| 4,769,860 | 9/1988 | Sargent et al. | 4/321 |
| 4,797,959 | 1/1989 | Decaux . | |
| 5,083,325 | 1/1992 | Vitullo | 4/479 |

FOREIGN PATENT DOCUMENTS

| | | |
|---|---|---|
| 2741562 | 3/1979 | Germany . |
| 608448 | 9/1948 | United Kingdom . |

*Primary Examiner*—Renee S. Luebke
*Assistant Examiner*—Charles R. Eloshway
*Attorney, Agent, or Firm*—Dann, Dorfman, Herrell and Skillman; Henry H. Skillman

[57] ABSTRACT

An apparatus for disposing of body waste in a portable toilet is comprised of a container (100) and an associated housing structure (14) which are adapted to be seated on a conventional toilet (B). Waste in container (100) is dumped into the toilet via a cable mechanism on the intake stroke of a hand pump (170). A water intake hose (172) is manually lowered into the toilet water via a hose control handle (162) prior to the operation of the pump. While the container (100) is in a vertical dumping position, the exhaust stroke of pump (170) forces water siphoned from the toilet through a jet outlet (180) to clean the interior of the container (100). The container (100) automatically returns to its rest, or horizontal, position due to the action of a return spring.

10 Claims, 4 Drawing Sheets

FLUSHABLE PORTABLE TOILET

RELATED APPLICATION

The present application is a continuation-in-part of Application No. PCT/US94/03350, filed Mar. 29, 1994, which is a continuation-in-part of Application No. 08/038,924, filed Mar. 29, 1993 and now abandoned.

FIELD OF THE INVENTION

The present invention relates to portable commodes having a removable waste container. More specifically, the invention relates to products such as a child's potty, medical commodes and bed pans which use waste containers to receive body waste. The removable container has a portable support which may be moved to afford dumping of the contents of the container into residential or institutional fixed commodes and rinsed with fresh water until clean. After cleaning, the container is returned to its operative position and fresh water may be deposited into the container to limit sticking of body waste to the container when reused.

BACKGROUND OF THE INVENTION

Known prior art devices include portable supports having removable waste containers. The portable supports are designed to accommodate infants or toddlers or medical patients who cannot use conventional fixed commodes because of their immaturity or their physical limitations. The prior portable commodes vary in size and design. For example, U.S. Pat. No. 5,083,325 discloses a portable commode in the form of an assimilation of an automobile. The Lumex Company of Bayshore, N.Y., markets a portable commode in the form of a chair having a cushion which comes off to access the commode. In practically all cases, the body waste container is independent of the seat portion of the support and either slides into position under the seat or is dropped into position under the seat on the support structure. With prior art portable commodes, water is usually deposited in the bottom of the waste container prior to use, and this water along with the waste is dumped into a fixed commode. The emptied container is then rinsed at a separate facility, such as an institutional or commercial sink, or a tub or shower, or similar source of fresh water. Depending upon the nature of the waste, the rinsing and dumping process is sometimes repeated frequently for cleaning satisfaction. In transferring the waste container from the commode for dumping to the water supply for rinsing, spillage may occur leading to unsanitary conditions.

Repeated rinsing of the waste container is wasteful of resources, and the present invention is designed to eliminate the necessity for repeated rinsing and dumping and transferring of the waste container from the water source to the fixed commode.

SUMMARY OF THE INVENTION

A primary object of the present invention is to provide an improved portable commode having a removable and reusable body waste container which may be cleaned by setting the portable commode on top of the waste-receiving bowl of a flush toilet and using fresh toilet water from the flushed toilet to rinse the waste container. The rinse water is dumped into the bowl.

The present invention provides a support for the waste container which inverts the waste container to rinse it and dump it while positioned on top of the fixed commode. The container has a horizontal rest position which renders the container in an operative waste-receiving condition and an inverted position which renders the container in a dumping condition.

Specifically, the present invention enables the use of fresh water from the bowl of the fixed commode to rinse the container as it is dumped into the bowl.

In a preferred embodiment, the use of water from the bowl of the fixed commode permits the discharge of the waste material from the waste container with a single flushing of the fixed commode after the waste container is dumped by operating the container from its operative condition to its dumping condition.

The present invention provides a flushing nozzle for the waste container which eliminates the need to remove the waste container from the portable support for cleaning and rinsing.

The present invention provides for automatic cleaning of the waste container by toilet water without need for special plumbing to supply additional water to the cleaning station.

The present invention enables a portable commode to incorporate the advantages of known prior art commodes with the additional advantage of ease of cleaning provided by the present invention.

BRIEF DESCRIPTION OF THE DRAWINGS

All of the objects of the invention are more fully set forth hereinafter with reference to the accompanying drawings, wherein.

DESCRIPTION OF THE PREFERRED EMBODIMENTS

Figure 1:
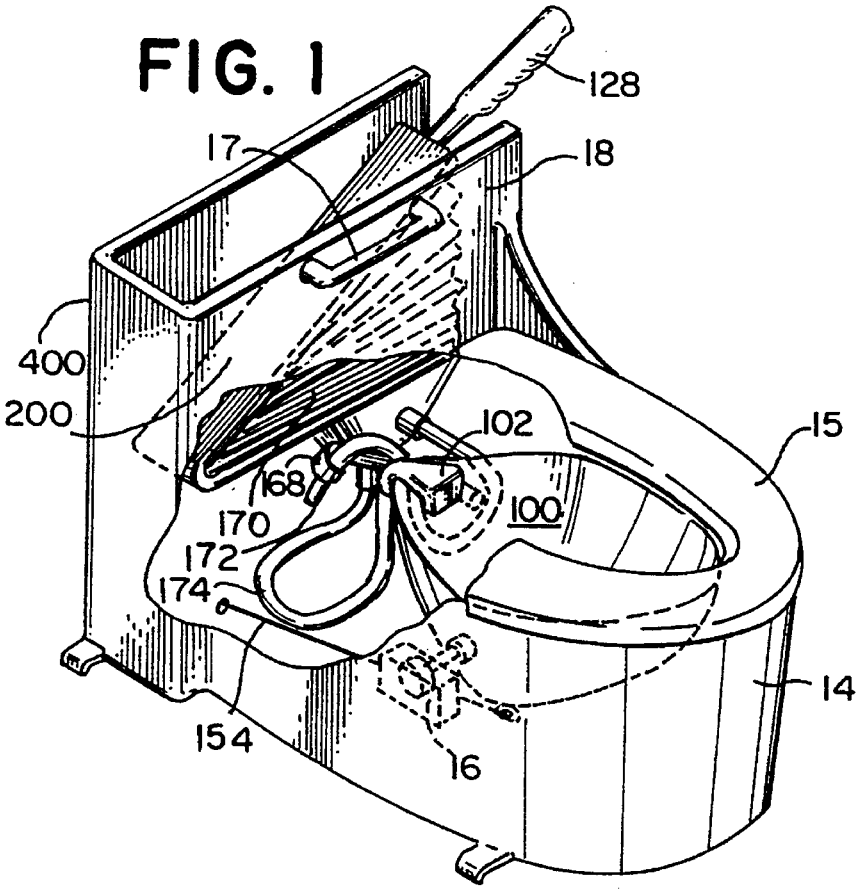
FIG. 1 is a perspective view of a portable commode embodying the present invention as seen from the front of the portable commode with portions broken away to shown interior parts.
Figure 2:
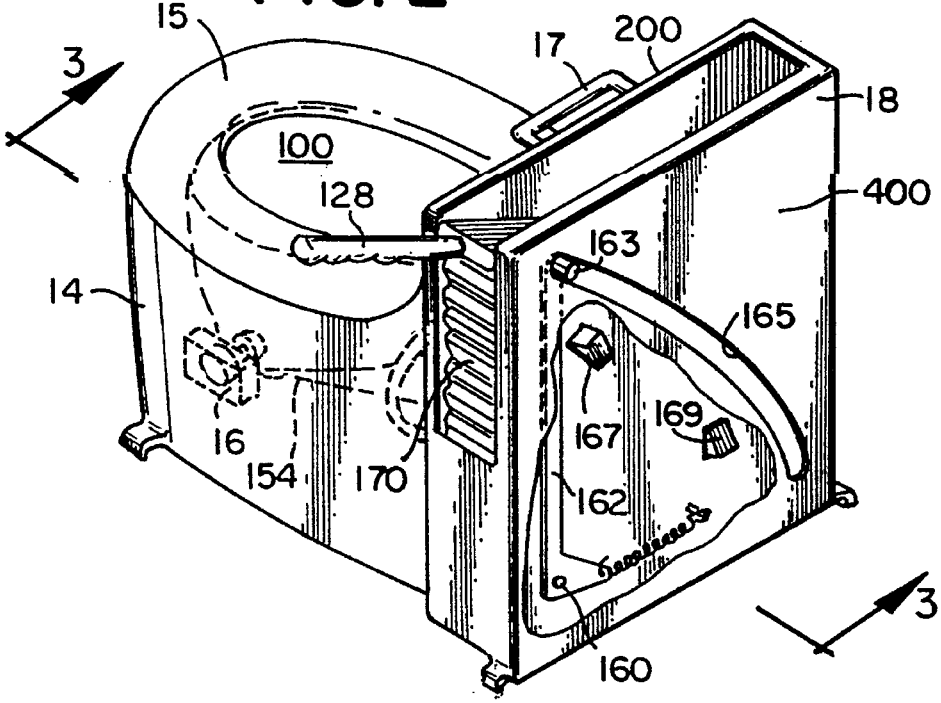
FIG. 2 is a rear perspective view of the portable commode shown in FIG. 1.
Figure 3:
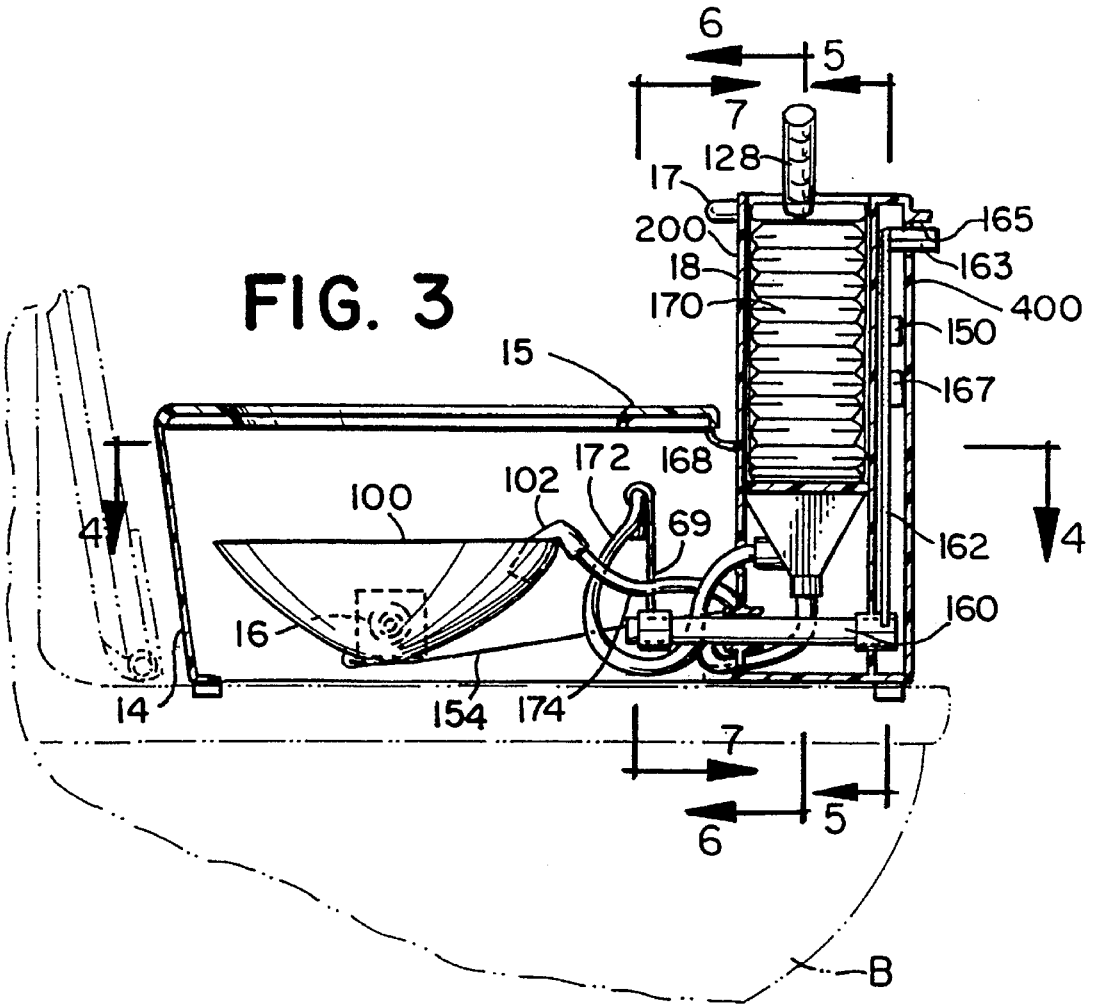
FIG. 3 is a sectional view taken on the line 3—3 showing the unit positioned on a fixed commode with its front facing the rear of the fixed commode (shown in broken lines)
Figure 4:
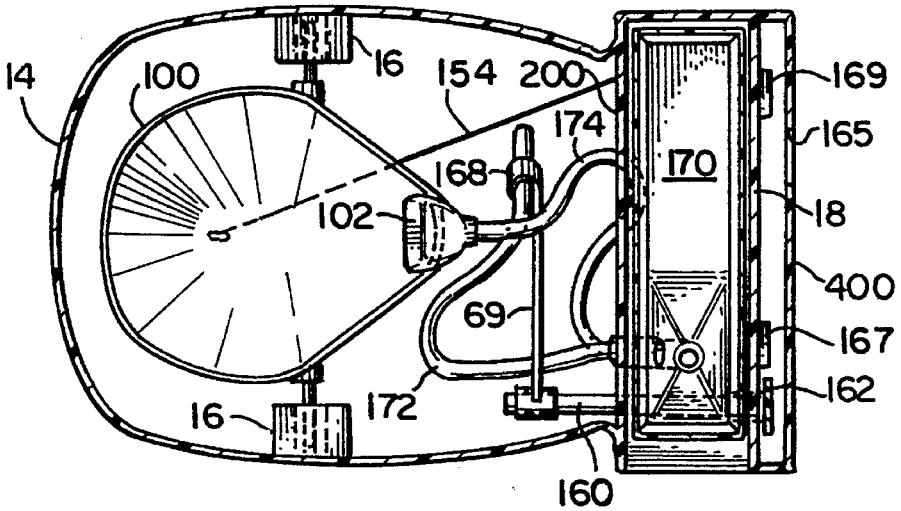
FIG. 4 is a horizonal sectional view taken on the line 4—4 of FIG. 3.
Figure 5:
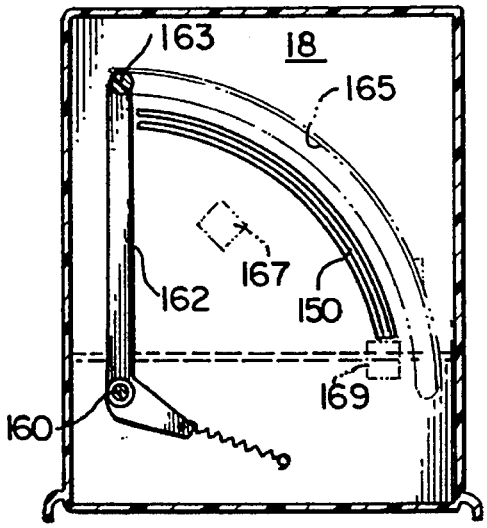
FIGS. 5, 6 and 7 are vertical sectional views taken on the lines 5—5, 6—6 and 7—7, respectively, of FIG. 3.
Figure 6:
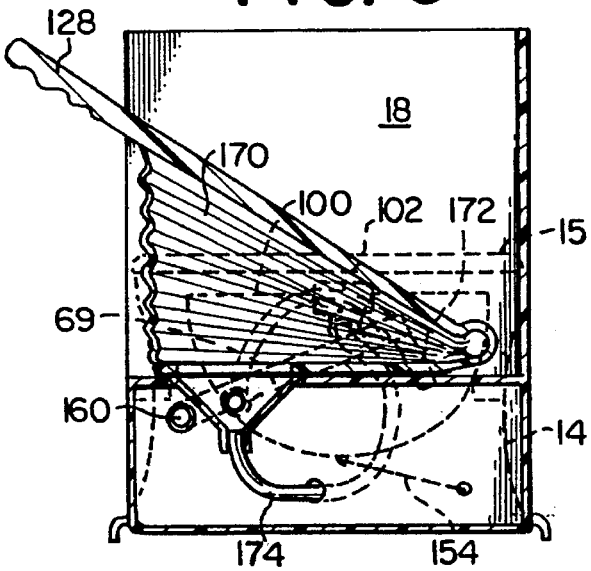
Figure 7:
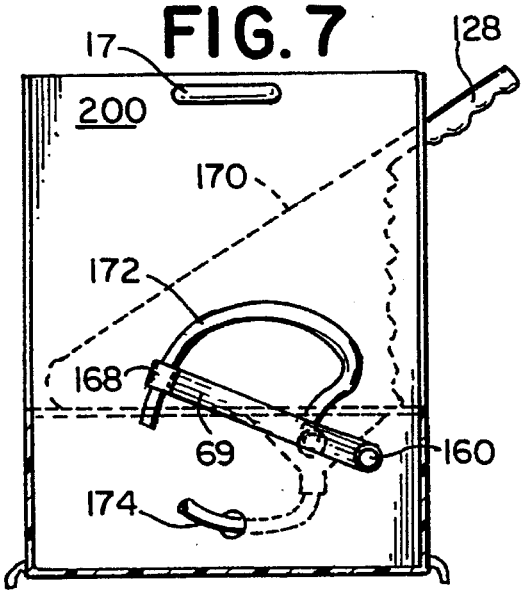

With reference to FIGS. 1, 2 and 3, a portable toilet embodying the present invention is illustrated, having a hollow support structure 14 with a seat 15 positioned on it. As shown in FIG. 1, the seat 15 is accessible from the front of the hollow support structure 14 so that when the support structure 14 is resting on the floor, the child may straddle the support structure 14 and sit on the seat 15. Behind the seat 15, there is a pump housing 18 having a handle 17 for carrying purposes and for stabilizing the portable toilet when it is resting on the fixed commode. As shown in FIGS. 3 and 4, the fixed commode is a regular household toilet whose bowl contains clean toilet water to receive waste for flushing into a sewer pipe or other drain, but the present invention may be used with any regular toilet having clean water for flushing. The bottom of the housing support structure 14 is configured to be supported on a regular toilet, as shown in FIG. 3.

A bellows-type pump 170 having a pump operator handle 128 is positioned within the pump housing 18 which is defined between a front wall 200 and a rear wall 400. A spring-powered hose control lever 162 is pivoted to the rear wall 400 and has an operator 163 projecting through an arcuate slot 165 in the wall 400. Pivotal movement of the lever 162 by the operator 163 causes the lever to pivot to the lower position past a latch actuator 167 and to engage behind a latching device 169 adjacent the bottom of the slot. As shown in FIG. 3, the lever 162 has a pivot shaft 160 which is journaled in the walls 200 and 400 and has a hose arm 69 which extends radially from the shaft and has a hose holder 168 which engages the open end of an intake hose 172 of the pump 170. Preferably the intake end of the hose is a flexible conduit which incorporates a check valve to maintain the intake hose filled with toilet water, regardless of whether it is immersed in water or removed from water. When the lever 162 is in the upper position, the free end of the hose 172 is elevated into the interior of the housing 14 and when the lever is actuated to the bottom of the slot 165, the free end of the hose dips into the fresh toilet water in the bowl B of the fixed commode shown in broken lines in FIG. 3. The lever has a spring bias tending to return the lever to the top of the arcuate slot, but is latched in the lower position against the bias by a suitable latch 169 coupled to the pump handle 128 by a connection not shown in the drawing.

With the hose 172 dipped into the water in the bowl B, the pump 170 is actuated by rotating the handle 128 on an axle to fill the bellows of the pump with water from the bowl B. Preferably, the pump handle 128 is lowered prior to or concurrently with the displacement of the lever 162 to evacuate the bellows so that the bellows may be filled with water from the bowl B by elevating the handle 128 to the position shown in FIG. 1. At that position, the bellows is filled with fresh toilet water from the bowl. The bellows of the pump 170 constitutes a pump chamber which enables retention of the water drawn through the hose 172. Upon completion of the upward stroke of the pump handle 128, the latch which holds the lever 162 in the lower position is released to allow the lever to return to its upright position and thereby raise the end of the inlet hose 172 out of the toilet water and into the interior of the housing 14. The check valve in the outlet end of the hose maintains the hose 172 filled as it is elevated.

Within the housing 14, a waste container 100 is positioned in its waste-receiving condition shown in full lines in FIG. 3. The waste container 100 is journaled on pivots in the housing so that it may be rotated from the waste-receiving condition shown in FIG. 3 to a dumping position shown in full lines in FIG. 10D.

Figure 10A:
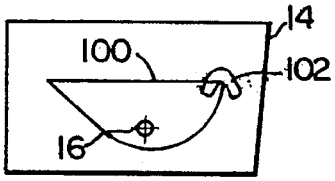
FIGS. 10A–10E are diagrammatic views showing the sequence of movement of the waste container.
Figure 8B:
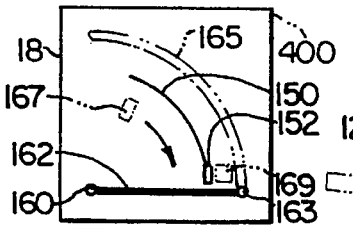
Figure 10B:
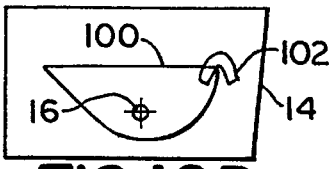
Figure 10C:
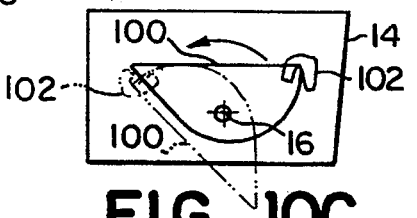
Figure 8D:
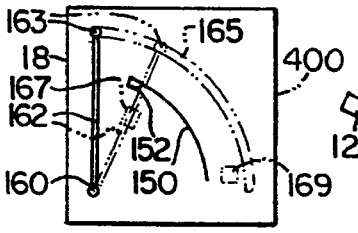
Figure 9D:
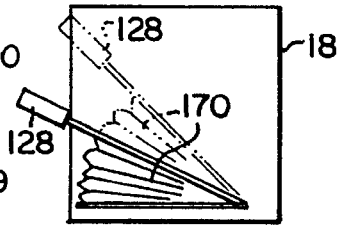
Figure 10D:
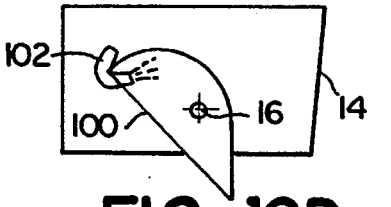
Figure 8E:
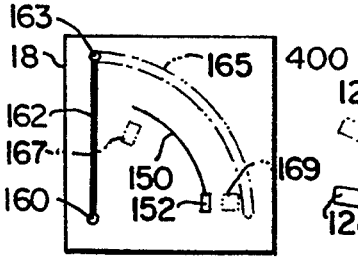
Figure 9E:
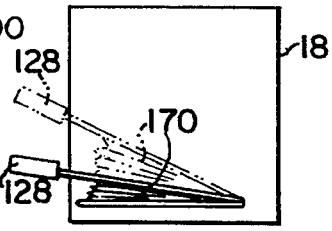

In the present instance, the container 100 is mounted in journals 16 for rotary movement between a horizontal rest position shown diagrammatically in FIG. 10A and an inverted dumping position shown in FIG. 10D. The container has a return spring (not shown) associated with the journals to bias the container to the rest position. The container 100 may be operated by a cable 154 attached to the bottom of the container 100 and extending through the pump housing 18. The end of the cable 154 is connected to a slider, shown diagrammatically at 152 in FIGS. 8A to 8E, which slides in an arcuate track 150 concentric with the arcuate slot 165. The container 100 is biased toward in its horizontal operative position shown in full lines FIG. 3 so that when the slider is displaced to the top of its track 150, the container 100 is inverted against the bias of the spring-loaded journals dumping position shown in FIG. 10D by the cable 154. Suitable guides in the form of pulleys and conduits (not shown) permit freedom of movement of the cable to actuate the container 100 between its two positions. Displacement of the cable operates against the bias of the spring-loaded journals to afford tilting of the container 100 to dump its contents in the bowl B.

Figure 8A:
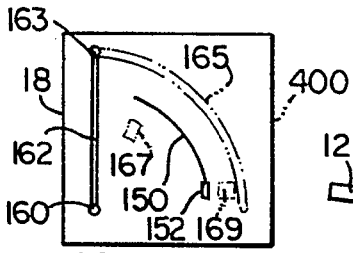
FIGS. 8A–8E are diagrammatic views illustrating the sequence of operation of the operating lever.
Figure 9A:
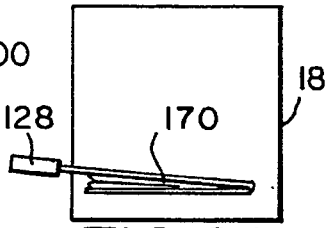
FIGS. 9A–9E are diagrammatic views showing the sequence of operation of the pump handle.

The operation of the device is diagrammed in FIGS. 8A–10E. After use of the portable toilet, the support 14 is placed on the bowl B with its forward end facing the back of the fixed bowl. Preferably, the conventional toilet seat on the bowl is raised so that the hollow support 14 rests directly on the bowl as shown in broken lines in FIG. 3. The handle 17 is used to stabilize the portable toilet as the device is operated. At this point, the lever 162 is upright as shown in FIG. 8A; the pump handle 128 is down to collapse the bellows 170 as shown in FIG. 9A, and the container 100 is in its horizontal loading position shown in FIG. 10A. In the first operation, the lever 163 is displaced to the bottom of the arcuate slot 165 as diagrammed in FIG. 8B so as to displace the free end of the hose 172 into the toilet water in the bowl B. The lever 162 has a spring bias tending to return the lever to the vertical position so that the displacement of the handle from the position shown in FIG. 8A to the position shown in FIG. 8B is effected against the bias of the spring. The lever is latched in its lower position, for example by the latch mechanism 169. When latched, the lever 162 also interlocks the end of the lever 162 with a slider 152 which rides in a track 150 behind the slot 165 shown diagrammatically in FIGS. 8A–8E.

Figure 9B:
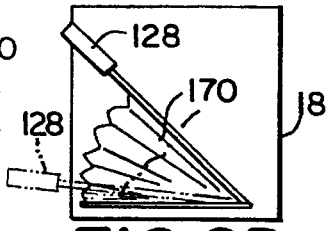
Figure 8C:
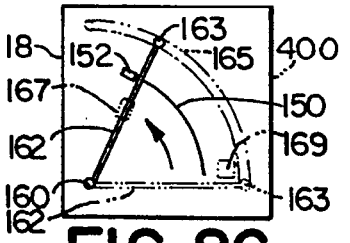
Figure 9C:
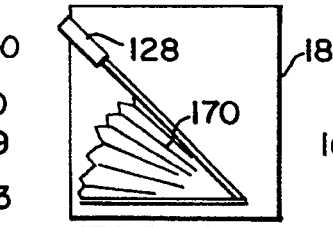

With the lever 162 latched in the lower position, the pump handle 128 may be raised as indicated in broken lines in FIG. 9B to expand the bellows chamber in the pump 170 and draw toilet water into the chamber bellows through the hose 172 whose end is immersed in the bowl. At the top of its stroke, the pump 170 actuates the latch mechanism 169 to release the lever 162 and permit it to return to its upright position shown in FIG. 8C, under the spring bias of the lever. Upward movement of the lever 162 lets the hose arm 69 raise the hose end 172 out of the bowl B.

Since the lever is interlocked with the slider 152 at the end of the cable, the slider 152 is displaced to the upper end of its arcuate track 150 when the lever is moved to the top of its slot 165. The movement of the slider 152 extends the cable and tilts the container 100 as shown in FIG. 10C against the bias of the spring return mechanism in the journal 16. The displacement of the pump handle 128 operates the pump 170 to discharge the toilet water from the pump chamber through a check valve (not shown) in the outlet hose 174 and through the jets of a flushing outlet nozzle 102 at the rear of the container 100. The forceful discharge of the toilet water through the hose 174 sprays the interior of the container to rinse any waste material which has not been dumped during the inversion of the container and discharges the rinse water along the rear wall of the container 100 and into the bowl.

Figure 10E:
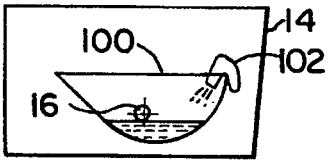

Before the pump chamber in the bellows pump is fully collapsed, for example when the chamber is 90% discharged, the downward movement of the handle 128 actuates the return mechanism for the container 100 so that the container is free to return to its horizontal position as shown in FIG. 10E under the action of the spring return mechanism in the journals 16. The pivotal return of the container 100 to the horizontal position extends the cable 154 to return its slide 152 to its normal position at the bottom of its track 150 where it is available to be engaged by the lever 162. Upon return of the container to its horizontal position, the final traverse of the pump handle to its bottom position discharges the toilet water remaining in the bellows compartment of the pump into the bottom of the container 100 to provide a residual amount of water to maintain the inside of the container sufficiently wet to avoid sticking of waste material to the bottom of the container during subsequent use. The portable potty may then be removed from the bowl B and the bowl may be flushed in the usual way.

If it is found that the container 100 required additional rinsing, the cycle may be repeated after flushing the bowl B.

The particular mechanisms described in connection with the preferred embodiment are not critical to the operation of the invention and different mechanical movements and operating parts may be employed to achieve the desired results. For example the preferred embodiment of the invention draws toilet water from the same part of the fixed commode which later receives the waste discharged from the container. Where the design of the regular toilet permits, the toilet water may be drawn from a different part of the fixed commode, or from a separate source of toilet water.

I claim:

1. A portable toilet having a container with an interior adapted to receive body waste and an associated housing structure configured to be supported on a regular flush toilet having a waste-receiving bowl connected to a drain, a supply of toilet water, and means to introduce the toilet water into the bowl to be discharged from the bowl into the drain, said portable toilet including a pump having a pump chamber, a pump operator, and an outlet, means operable upon displacement of said operator in one direction to introduce said toilet water into said pump chamber, said pump operator displaceable in the opposite direction to evacuate said toilet water from the chamber through said outlet, means to support said container for movement between a rest condition in which said container interior receives body waste and a dumping condition in which said container is free to discharge the received body waste from its interior into said bowl, and means to operate said container from said rest condition to said dumping condition upon displacement of said operator in said one direction, said pump outlet including a jet directed toward the interior of the container in its dumping condition so that upon actuation of said pump operator in said opposite direction, the toilet water in the pump chamber is ejected through said jet into the interior of the container to facilitate the discharge of the body waste from the container into the toilet bowl.

2. A portable toilet having a container with an interior adapted to receive body waste and an associated housing structure configured to be supported on a regular toilet having a waste-receiving bowl connected to a drain, a supply of toilet water, and means to introduce the toilet water into the bowl to be discharged from the bowl into the drain, said portable toilet including a pump having a pump operator and a chamber, an extensible inlet having a free end, and an outlet, said pump operator being displaceable in one direction to draw toilet water into said chamber through said inlet and displaceable in the opposite direction to evacuate water from the chamber through said outlet, means to extend the free end of said extensible inlet into said toilet water upon displacement of said pump operator in said one direction so as to introduce toilet water into said chamber during said displacement of said operator in said one direction, and to withdraw the free end from said toilet water after displacement of said operator in said one direction, means to support said container for movement between a rest condition in which said container interior receives body waste and a dumping condition in which said container is free to discharge the received body waste from its interior into said bowl, and means to move said container from said rest condition to said dumping condition after withdrawal of said free end from said toilet water, said pump outlet directed toward the interior of the container so that upon actuation of said pump operator in said opposite direction, the toilet water in the chamber is evacuated into the interior of the container to facilitate the discharge of the received body waste from the container into the toilet bowl.

3. A portable toilet according to claim 2 including a return mechanism to return said container to said rest condition prior to complete evacuation of said pump chamber, so that the final displacement of said pump operator in the opposite direction introduces toilet water from said chamber into said container in its rest condition.

4. A portable toilet according to claim 3 wherein said return mechanism normally biases the container toward said rest condition, and including cable means operable to overcome the bias of said return mechanism during displacement of said container from said rest condition to said dumping condition to retain said container in the dumping condition, and means operable during displacement of said pump operator in said opposite direction to release said cable means and allow said container to return to said rest condition under the bias of said return mechanism.

5. A portable toilet according to claim 2 wherein said chamber comprises a pump chamber and said pump outlet includes a jet to forcefully discharge the toilet water against the interior of said container.

6. A portable toilet according to claim 2 wherein said pump operator is operatively connected to said inlet to withdraw said free end from said toilet water automatically when the chamber is filled.

7. A portable toilet according to claim 2 wherein said extensible inlet comprises a flexible inlet hose.

8. A portable toilet having a container with an interior adapted to receive body waste and an associated housing structure configured to be placed over an existing toilet bowl connected to a drain, said toilet bowl having a supply of toilet water, and means to introduce the toilet water into the bowl to be discharged from the bowl into said drain, said portable toilet including a chamber and an outlet, means to introduce said toilet water from said bowl into said chamber and to cause said water to flow from the chamber through said outlet, means to support said container in said housing structure for movement between an operative condition in which said container interior receives body waste and a dumping condition in which said container is free to discharge the body waste into said bowl, means tending to return said container to the operative condition, and means to move said container from said operative condition to said dumping condition, said outlet being directed toward the interior of the container so that said toilet water in the chamber flows through said outlet into the interior of the container to facilitate the discharge of the body waste from the container into the toilet bowl.

9. A portable toilet according to claim 8, wherein said means to introduce toilet water into said chamber includes a hose which intakes toilet water from said bowl.

10. A portable toilet according to claim 8, wherein said means to support said container positions said container horizontally in said operative condition and tilts said container in said dumping condition.

* * * * *

UNITED STATES PATENT AND TRADEMARK OFFICE

CERTIFICATE OF CORRECTION

PATENT NO. : 5,615,420

DATED : April 1, 1997

INVENTOR : Dean L. Guyton

It is certified that errors appear in the above-identified patent and that said Letters Patent is hereby corrected as shown below:

Column 4, line 3, after "journals" insert --to the--;

line 37, after "chamber" delete "bellows--;

Column 5, line 24, delete "toilet".

Signed and Sealed this

Sixteenth Day of December, 1997

*Attest:*

*Attesting Officer*

BRUCE LEHMAN

*Commissioner of Patents and Trademarks*